US008576152B2

(12) United States Patent
Sun

(10) Patent No.: US 8,576,152 B2
(45) Date of Patent: Nov. 5, 2013

(54) LIQUID CRYSTAL DISPLAY AND METHOD FOR DRIVING SAME

(75) Inventor: Mei-Yang Sun, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 465 days.

(21) Appl. No.: 12/908,004

(22) Filed: Oct. 20, 2010

(65) Prior Publication Data

US 2011/0096064 A1 Apr. 28, 2011

(51) Int. Cl.
*G09G 3/36* (2006.01)

(52) U.S. Cl.
USPC ..... 345/94; 345/87

(58) Field of Classification Search
USPC ..... 345/87–100
See application file for complete search history.

(56) References Cited

U.S. PATENT DOCUMENTS

| | | | | |
|---|---|---|---|---|
| 6,191,769 | B1 * | 2/2001 | Fujiwara et al. | 345/99 |
| 2007/0024560 | A1 * | 2/2007 | Kim et al. | 345/94 |
| 2008/0068321 | A1 * | 3/2008 | Kim et al. | 345/90 |

FOREIGN PATENT DOCUMENTS

| | | | |
|---|---|---|---|
| CN | 1674082 | A | 9/2005 |
| CN | 101324727 | A | 12/2008 |
| JP | 2003-330425 | A | 11/2003 |
| JP | 2003330425 | A * | 11/2003 |
| TW | 200849184 | A | 12/2008 |

* cited by examiner

*Primary Examiner* — Viet Pham
(74) *Attorney, Agent, or Firm* — Bacon & Thomas, PLLC

(57) ABSTRACT

A liquid crystal display includes a liquid crystal panel having a plurality of pixel units, a scanning driver configured to provide scanning signals to scan the pixel units, a data driver configured to provide data voltage signals to the pixel electrode of the pixel units; and a common voltage driver configured to provide a common voltage signal to the common electrodes of the pixel units. Each pixel unit includes a pixel electrode and a common electrode, and the pixel units cooperatively display picture frame by frame. A dummy cycle period is defined between two sequent normal frame periods. The common voltage signal is an alternating current voltage signal in each normal frame period, and a polarity of the common voltage signal is fixed in the dummy cycle. A method for driving a liquid crystal display is also provided.

18 Claims, 6 Drawing Sheets

LIQUID CRYSTAL DISPLAY AND METHOD FOR DRIVING SAME

BACKGROUND

1. Technical Field

The present disclosure relates to liquid crystal display (LCD) technology, and more particularly, to an LCD applied with an inversion driving system, and a method for driving the LCD.

2. Description of Related Art

LCDs are widely used in various portable information products, such as notebooks, personal digital assistants, video cameras, and the like.

An LCD includes a liquid crystal panel having a plurality of pixel units arranged as a matrix. The LCD utilizes liquid crystal molecules to control light transmission in each pixel. In particular, the liquid crystal molecules are driven according to external driving signals received by the LCD. For example, a data voltage signal and a common voltage signal can respectively be applied to a pixel electrode and a common electrode of the pixel unit, which cooperatively constitute an electric field between the pixel electrode and the common electrode. The electric filed tilts the liquid crystal molecules in the pixel unit to desired angles, and thus the light transmission of the pixel unit is controlled. As such, the pixel unit is enabled to display a picture element, and the aggregation of picture elements displayed by all the pixel units simultaneously constitutes an image displayed on the liquid crystal panel.

To protect the liquid crystal molecules from decay or damage, the LCD typically employs a inversion driving system, for example, a frame inversion system, a line inversion system, or a dot inversion system. The inversion driving system requires a polarity of the electric fields of the pixel unit to be reversed at least once during two sequent frame periods. To meet this requirement, generally, a positive common voltage signal and a negative common voltage signal are applied to the common electrode of the pixel unit alternately. However, such common voltage signal with alternating polarities may induce resonance, by which undesired noise may be generated in the LCD. This may lower a quality of the LCD.

What is needed, therefore, is an LCD and a method for driving the LCD, which can overcome the described limitations.

BRIEF DESCRIPTION OF THE DRAWINGS

The components in the drawings are not necessarily drawn to scale, the emphasis instead placed upon clearly illustrating the principles of at least one embodiment. In the drawings, like reference numerals designate corresponding parts throughout the various views.

DETAILED DESCRIPTION

Reference will now be made to the drawings to describe certain exemplary embodiments of the present disclosure in detail.

Figure 1:
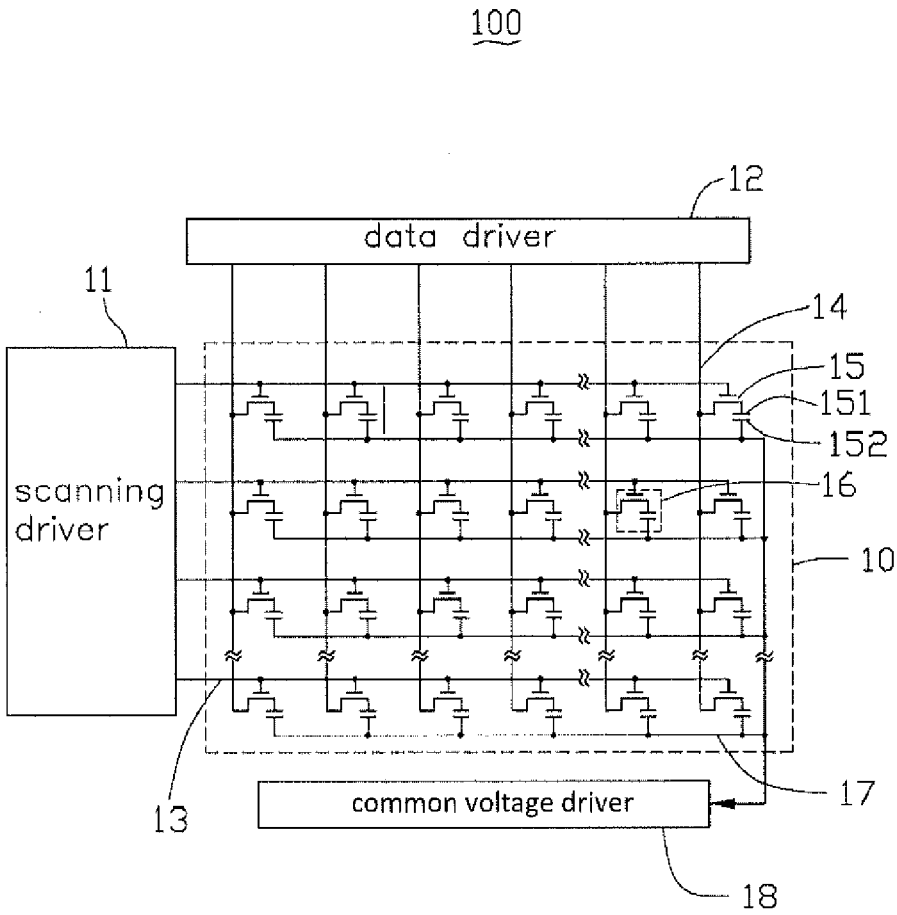
FIG. 1 is a partial schematic diagram of an LCD according to a first embodiment of the present disclosure.

FIG. 1 is a partial schematic diagram of an LCD 100 according to a first embodiment of the present disclosure. The LCD 100 can be applied with an inversion driving system to drive liquid crystal molecules of the LCD 100. The LCD 100 includes a liquid crystal panel 10, a scanning driver 11, a data driver 12, and a common voltage driver 18.

The liquid crystal panel 10 includes n rows of parallel scanning lines 13 (where n is a natural number), n rows of parallel common lines 17 alternately arranged with the scanning lines 13, m columns of parallel data lines 14 perpendicular to the scanning lines 13 and the common lines 17 (where m is also a natural number), and a plurality of pixel units 16 cooperatively defined by the crossing scanning lines 13 and data lines 14. The pixel units 16 are arranged in a matrix having n rows and m columns. The scanning lines 13 are electrically coupled to the scanning driver 11, and are configured to transmit scanning signals provided by the scanning driver 11 to the pixel units 16. The data lines 14 are electrically coupled to the data driver 12, and are configured to transmit data voltage signals provided by the data driver 12 to the pixel units 16. The common lines 17 are electrically coupled to the common voltage driver 18, and are configured to transmit common voltage signals provided by the common voltage driver 18 to the pixel units 16.

Each pixel unit 16 includes a thin film transistor (TFT) 15, a pixel electrode 151, and a common electrode 152. A gate electrode of the TFT 15 is electrically coupled to a corresponding scanning line 13, and a source electrode of the TFT 15 is electrically coupled to a corresponding data line 14. Further, a drain electrode of the TFT 15 is electrically coupled to the pixel electrode 151. The common electrode 152 is electrically coupled to a corresponding common line 17. In particular, the common electrode 152 is opposite to the pixel electrode 151, with a plurality of the liquid crystal molecules (not shown) sandwiched therebetween, and thereby cooperatively forming a liquid crystal capacitor.

Figure 2:
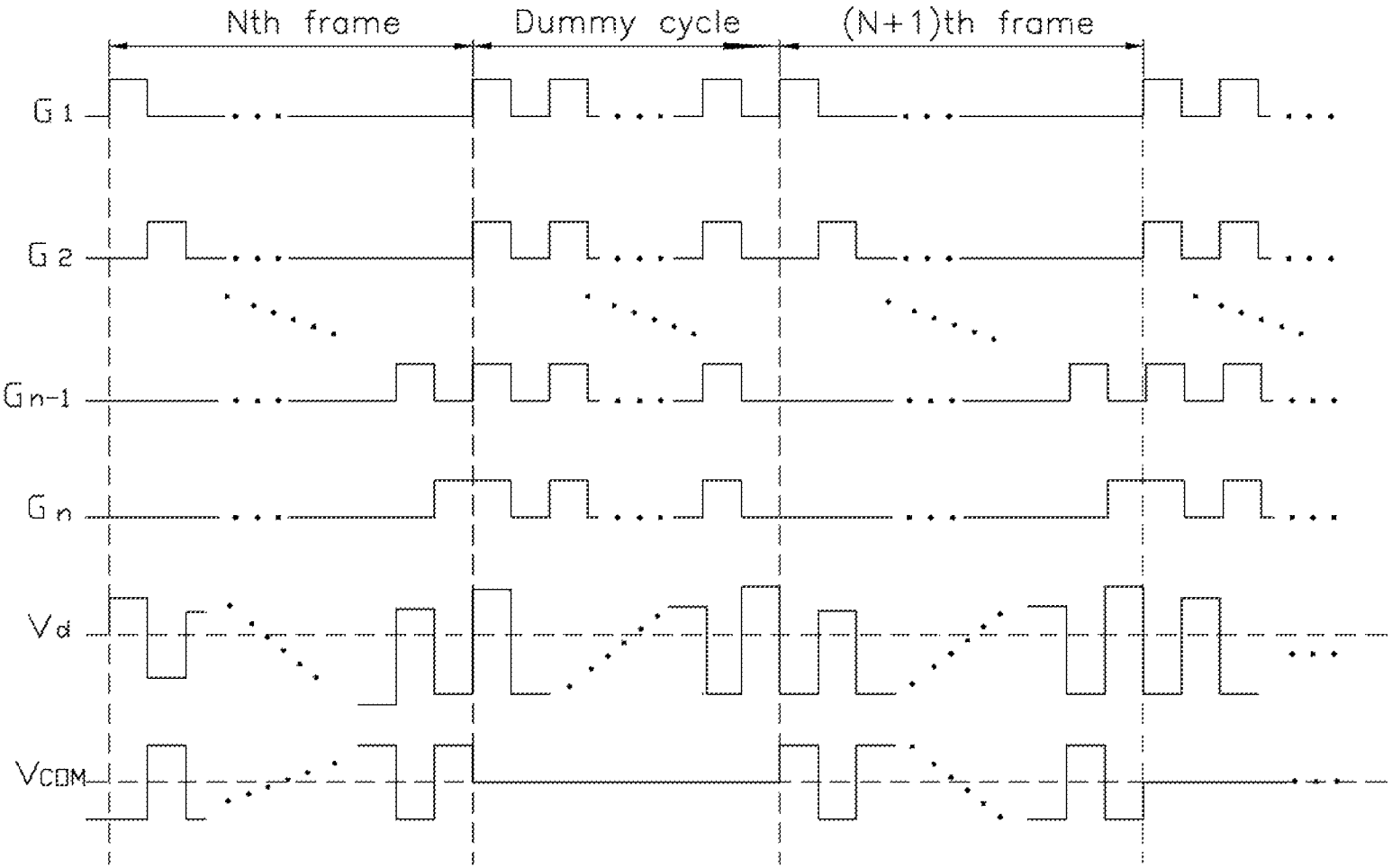
FIG. 2 shows waveforms of driving signals applied to the LCD of FIG. 1 in two sequent frame periods.

Referring also to FIG. 2, waveforms of driving signals applied to the LCD of FIG. 1 in two sequent frame periods are shown. The driving signals include the scanning signals G1~Gn applied to the scanning lines 13, the data voltage signal Vd applied to one of the data lines 14, and the common voltage signal Vcom applied to the common lines 17. As shown in FIG. 2, a dummy cycle period is defined between two sequent frame periods, for example, Nth frame and (N+1) th frame. Additionally, the common voltage signal Vcom is a square wave signal having a positive value and a negative value alternating with each other in each frame period, and in the dummy cycle period, the common voltage signal Vcom is set to a direct current (DC) voltage signal having a predetermined value.

Specifically, when the LCD 100 is in operation, in an Nth frame period, the scanning driver 11 generates a plurality of scanning signals G1~Gn, and outputs the scanning signals G1~Gn to the scanning lines 13 sequentially, so as to activate the pixel units 16 row by row via switching the corresponding TFTs 15 on. The data driver 12 generates a plurality of data voltage signals Vd, and outputs the data voltage signals Vd to the corresponding activated pixel units 16 via the data lines 14 and the corresponding TFTs 15. The common voltage driver 18 generates a common voltage signal Vcom, and outputs the common voltage signal Vcom to the pixel units 16. Thereby, the liquid crystal capacitors in the activated row of pixel units 16 are charged. An electric field is generated between the pixel electrode 151 and the common electrode 152 in each activated pixel unit 16 due to the charging process, and the electric field drives the liquid crystal molecules in the pixel unit 16 to control the light transmission of the pixel unit 16, such that the pixel unit 16 displays a particular picture element such as a red picture element, a green picture element, or a blue picture element having a corresponding gray level. The aggregation of picture elements displayed by all the pixel units 16 simultaneously constitutes a viewable display on the LCD 300.

Moreover, in the described row-by-row activation process, the data voltage signal Vd applied to a certain data line 14 is an alternating current (AC) voltage signal having a positive value and a negative value alternating with each other, and the common voltage signal Vcom applied to the common lines 17 is also an AC voltage signal having a positive value and a negative value alternating with each other in the normal frame period, but has a polarity reversed to the data voltage signal Vd. Moreover, a positive value of the common voltage signal Vcom can be 3V, and a negative value of the common voltage signal Vcom can be −3V.

After the last row, that is the nth row of pixel units 16 is activated to display corresponding picture elements, the Nth frame period is finished, and the LCD 100 enters a dummy cycle period. The dummy cycle period provides the data driver 12 of the LCD 100 with a latency time period for preparing data voltage signals corresponding to the subsequent frame period, that is the (N+1)the period). During the dummy cycle period, all the scanning lines 13 are applied with a same predetermined square wave signal having a frequency substantially n times of the scanning signals, and the data voltage signal Vd applied to the data line 14 can also be pre-configured in data driver 12. For example, the data voltage signal Vd in the dummy cycle period may be repeated as that applied to the data line 14 in the previous frame period, that is the Nth frame period).

Moreover, as described, the common voltage signal Vcom in the dummy cycle period can be preset as a DC voltage signal having a predetermined value. In one embodiment, the predetermined value may be in a range between the positive value and the negative value of the AC voltage signal of the common voltage signal, for example, the predetermined value may be half of a sum of the positive value and the negative value of the common voltage signal Vcom in the previous frame period, for example, 0V. In particular, the common voltage signal Vcom can be set to 0V in the dummy cycle period by removing the common voltage signal Vcom, or in an alternative embodiment, and the common voltage signal Vcom can be set to 0V by grounding the common lines 17.

In addition, a length of the dummy cycle period is relevant to a time period for the data driver 12 to prepare data voltage signals corresponding to the subsequent frame period, and may be preset according to a resolution of the liquid crystal panel 10. For example, if the liquid crystal panel 10 displays a physical resolution of 240*320, in which a length of each frame period is about 16.6 ms (milliseconds), the dummy cycle period may correspondingly have a length of about ⅕~¼ of the length of the normal frame period, such as in a range between 3 ms and 4 ms. In an alternative embodiment, the length of the dummy cycle period can also be preset as a variable value.

When the dummy cycle period ends, the LCD 100 enters the (N+1)th frame period. In the (N+1)th frame period, the scanning driver 11 re-activates the pixel units 16 row by row, and the data driver 12 and the common voltage driver 18 respectively output the data voltage signals Vd and the common voltage signal Vcom to the corresponding activated pixel units 16, so as to enable the activated pixel unit 16 to display a particular picture element. Thereafter, the normal frame period and the dummy cycle period are alternately performed in the LCD 100.

The LCD 100 of the present disclosure introduces the dummy cycle period between two sequent frame periods, the dummy cycle period may prevent resonance in the LCD 100 canceling undesired noise that might otherwise intensively exist in the LCD to be decreased. Therefore, the quality of the LCD 100 is improved.

Figure 3:
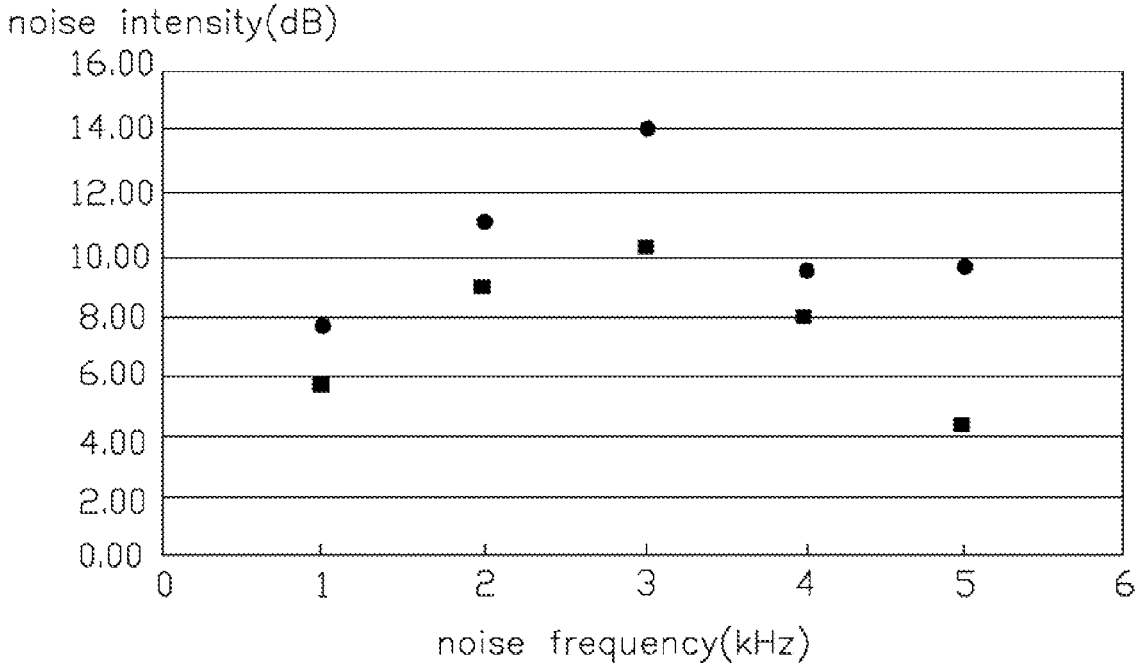
FIG. 3 illustrates a noise decrement of the LCD of FIG. 1.

FIG. 3 illustrates a noise decrement of the LCD 100, in which circular dot symbols represent noise values measured in an LCD without the dummy cycle period, and square dot symbols represent noise values measured in the LCD 100 according to the present disclosure. The measurement of the noise with a frequency below 1 KHz requires a noise intensity of the environment to be not greater than 10 dB, and the measurement of the noise with a frequency over 1 KHz requires a noise intensity of the environment to be not greater than 5 dB. From the illustration of FIG. 3, it can be found that the noise is distinctly reduced in the LCD 100 due to the introduction of dummy cycle period between two sequent frame period, for example, the noise with a frequency of 3 KHz is decreased about 4 dB (from 14 dB to 10 dB), and the noise with a frequency of 5 KHz is decreased about 6 dB (from 10 dB to 4 dB). As can be seen, the introduction of dummy cycle period can reduce the noise in the LCD 100, and therefore, the quality of the LCD 100 can be improved.

Figure 4:
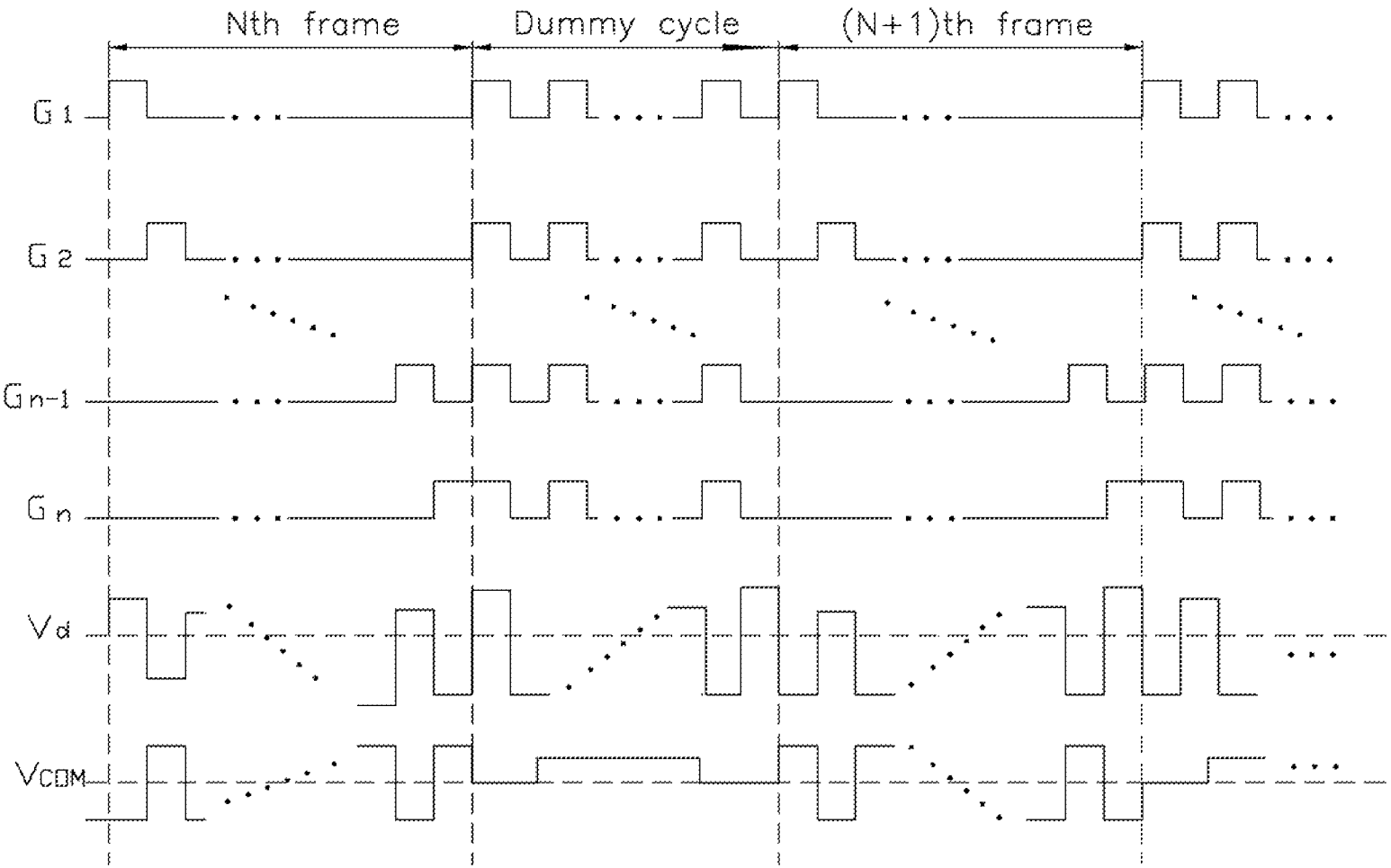
FIG. 4 shows waveforms of driving signals applied to an LCD according to a second embodiment of the present disclosure.

FIG. 4 shows waveforms of driving signals applied to an LCD according to a second embodiment of the present disclosure. The LCD is similar to the described LCD 100, except that in the dummy cycle period of the LCD of the second embodiment, the common voltage signal Vcom is not the DC signal with the fixed value, instead, the common voltage signal Vcom in the second embodiment may be a positive voltage signal having a variable value (including 0V), or a negative voltage signal having a variable value (including 0V), that is a polarity of the common voltage signal Vcom is fixed in the dummy cycle. In one embodiment, as shown in FIG. 4, the dummy cycle period can be divided into a first sub-period at the beginning of the dummy cycle period, a second sub-period at the end of the dummy cycle period, and a third sub-period between the first and second sub-periods, moreover, the common voltage signal Vcom are both 0V in the first and second sub-periods, and have a predetermined positive value in the third sub-period.

Figure 5:
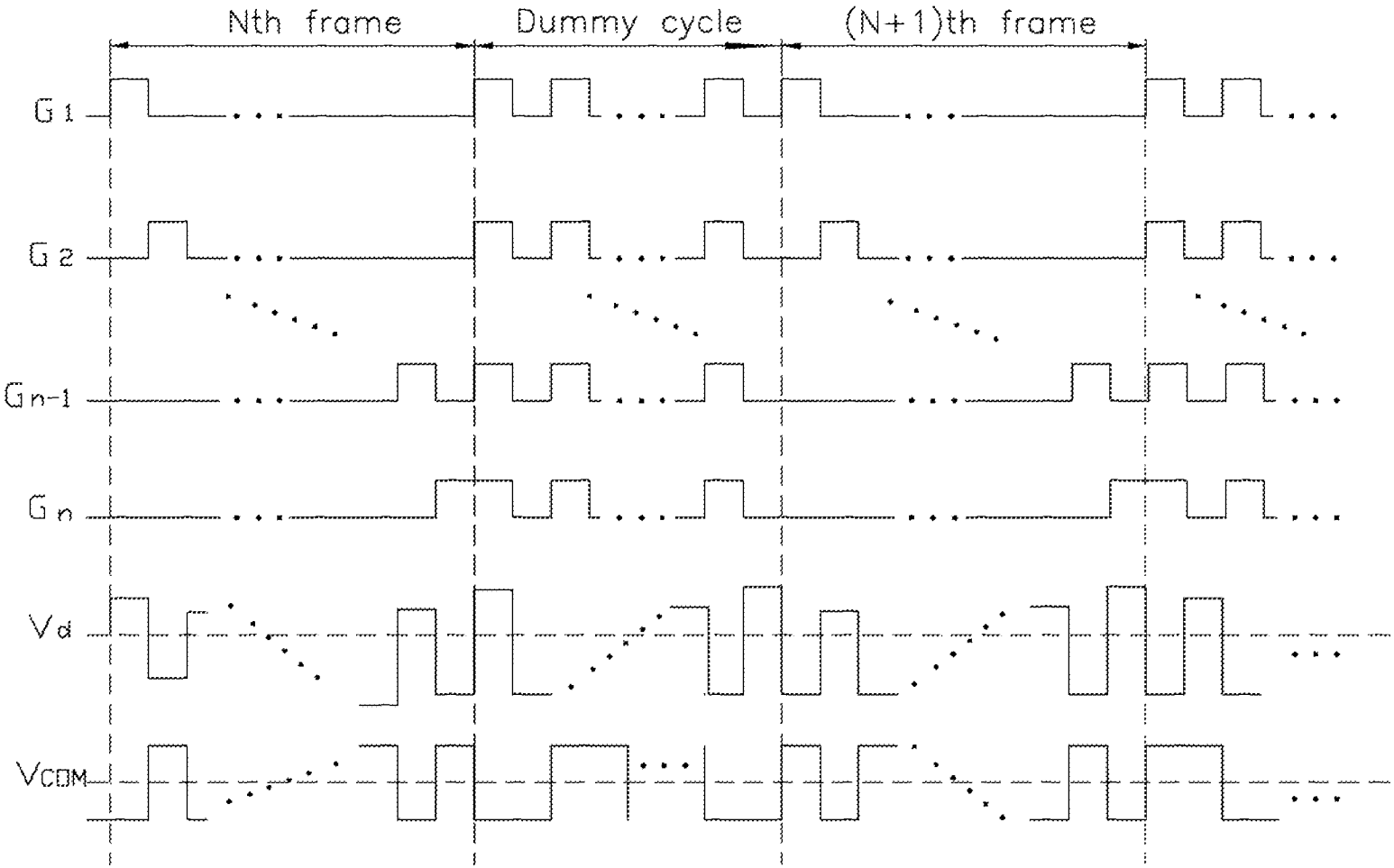
FIG. 5 shows waveforms of driving signals applied to an LCD according to a second embodiment of the present disclosure.

FIG. 5 shows waveforms of driving signals applied to an LCD according to a third embodiment of the present disclosure. The LCD is similar to the described LCD 100, except that in the dummy cycle period of the LCD of the third embodiment, the common voltage signal Vcom is not a DC voltage signal, rather, the common voltage signal Vcom in the dummy cycle period is an AC voltage signal. The AC voltage signal having a positive value and a negative value the same as that of the common voltage signal Vcom in the normal frame period, but having a frequency less than that of the common voltage signal Vcom in the normal frame period. For example, a frequency of the AC voltage signals can be about half that of the common voltage signal Vcom in the normal frame period.

Figure 6:
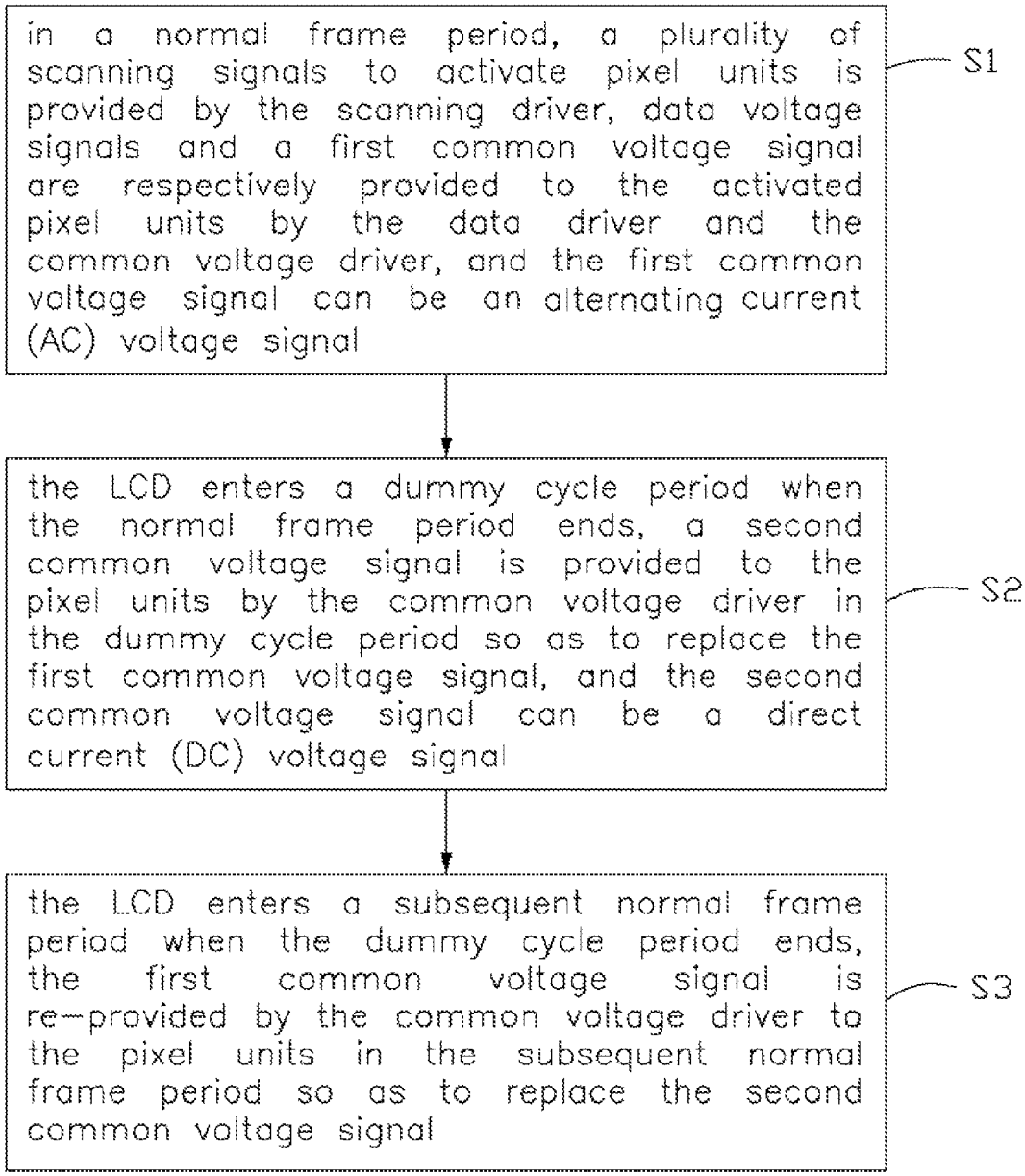
FIG. 6 shows waveforms of a method for driving the LCD according to an exemplary embodiment of the present disclosure.

FIG. 6 shows a method for driving the LCD according to the present disclosure, as follows. It is noted that details of steps in FIG. 6 can be found in the above description of the operation of the LCD 100.

Referring to FIG. 6, in step S1, in a normal frame period, a plurality of scanning signals to activate pixel units is provided by the scanning driver, data voltage signals and a first common voltage signal are respectively provided to the activated pixel units by the data driver and the common voltage driver, and the first common voltage signal can be an alternating current (AC) voltage signal. In detail, the first common voltage is an AC voltage signal having a positive value and a negative value alternating with each other.

In step S2, the LCD enters a dummy cycle period when the normal frame period ends, a second common voltage signal is provided to the pixel units by the common voltage driver in the dummy cycle period so as to replace the first common voltage signal, and the second common voltage signal can be a direct current (DC) voltage signal. In detail, the second common voltage signal can be a DC voltage signal having a predetermined value, and the predetermined value can be a fixed value in a range between the positive value and the negative value of the AC voltage signal, for example, half of a sum of the positive value and the negative value of the common voltage signal in the normal frame period. Besides, during the dummy cycle period, a same preconfigured square wave signal is provided to all the pixel units by the scanning driver, and the data voltage signals of the normal frame period are repeated to output to the pixel units by the data driver. In this step, the preconfigured square wave signal serves as the scanning signal of the dummy cycle period, and the predetermined square wave signal has a frequency substantially n times of the scanning signals in the normal frame period.

In step S3, the LCD enters a subsequent normal frame period when the dummy cycle period ends, the first common voltage signal is re-provided by the common voltage driver to the pixel units in the subsequent normal frame period so as to replace the second common voltage signal.

It is to be further understood that even though numerous characteristics and advantages of a preferred embodiment have been set out in the foregoing description, together with details of the structures and functions of the embodiments, the disclosure is illustrative only; and that changes may be made in detail, especially in matters of shape, size and arrangement of parts within the principles of disclosure to the full extent indicated by the broad general meaning of the terms in which the appended claims are expressed.

What is claimed is:

1. A liquid crystal display, comprising:

a liquid crystal panel having a plurality of pixel units, each pixel unit comprising a pixel electrode and a common electrode, and the pixel units cooperatively displaying pictures frame by frame;

a scanning driver configured to provide scanning signals to scan the pixel units;

a data driver configured to provide data voltage signals to the pixel electrodes of the pixel units; and a common voltage driver configured to provide a common voltage signal to the common electrodes of the pixel units;

wherein a dummy cycle period is defined between two sequent normal frame periods, the common voltage signal is an alternating current (AC) voltage signal in each normal frame period, and a polarity of the common voltage signal is fixed in the dummy cycle, and wherein the common voltage signal is one of a positive voltage signal having a variable value and a negative voltage signal having a variable value; the dummy cycle period comprises a first sub-period at the beginning of the dummy cycle period, a second sub-period at the end of the dummy cycle period, and a third sub-period between the first and second sub-periods, a value of the common voltage signal in the first sub-period is substantially the same as that in the second sub-period, and is less than that in the third sub-period.

2. The liquid crystal display of claim 1, wherein the common voltage signal is an AC voltage signal having a positive value and a negative value alternating with each other in the normal frame period, and is a direct current (DC) voltage signal having a predetermined value in a range between the positive value and the negative value of the AC voltage signal.

3. The liquid crystal display of claim 2, wherein the predetermined value is half of a sum of the positive value and the negative value of the common voltage signal in the normal frame period.

4. The liquid crystal display of claim 2, wherein the predetermined value is preset as 0 volts.

5. The liquid crystal display of claim 1, wherein the scanning driver outputs the scanning signals to the pixel units via n rows of scanning lines, and the data driver outputs the data voltage signals to the pixel units via m columns of data lines; during the dummy cycle period, all the scanning lines are applied with a same predetermined square wave signal having a frequency substantially n times of the scanning signals in the normal frame period.

6. The liquid crystal display of claim 5, wherein the data voltage signals outputted to the pixel units in the dummy cycle period are repeated as that in a previous normal frame period.

7. The liquid crystal display of claim 1, wherein the dummy cycle period is configured to provide the data driver with a latency time period for preparing data voltage signals corresponding to a subsequent normal frame period.

8. The liquid crystal display of claim 7, wherein a length of the dummy cycle period is relevant to a resolution of the liquid crystal panel.

9. The liquid crystal display of claim 7, wherein a length of the dummy cycle period is preset as a variable value.

10. A liquid crystal display, comprising:

a liquid crystal panel having a plurality of pixel units, each pixel unit comprising a pixel electrode and a common electrode, and the pixel units cooperatively displaying pictures frame by frame;

a scanning driver configured to provide scanning signals to scan the pixel units;

a data driver configured to provide data voltage signals to the pixel electrode of the pixel units; and a common voltage driver configured provide a common voltage signal to the common electrodes of the pixel units;

wherein a dummy cycle period is defined between two sequent normal frame periods, the common voltage signal is an alternating current (AC) voltage signal in both the normal frame period and the dummy cycle period, a frequency of the common voltage signal in the dummy cycle period is less than that of the common voltage signal in the normal frame period, and wherein the common voltage signal is one of a positive voltage signal having a variable value and a negative voltage signal having a variable value; the dummy cycle period comprises a first sub-period at the beginning of the dummy cycle period, a second sub-period at the end of the dummy cycle period, and a third sub-period between the first and second sub-periods, a value of the common voltage signal in the first sub-period is substantially the same as that in the second sub-period, and is less than that in the third sub-period.

11. The liquid crystal display of claim 10, wherein a frequency of the common voltage signal in the dummy cycle period is substantially half of that of the common voltage signal in the normal frame period.

12. The liquid crystal display of claim 11, wherein the scanning driver outputs a same predetermined square wave signal to all the pixel units during the dummy cycle period, the predetermined square wave signal has a frequency substantially n times of the scanning signals in the normal frame period.

13. The liquid crystal display of claim 12, wherein the data voltage signals outputted to the pixel units in the dummy cycle period are repeated as that in a previous normal frame period.

14. A method for driving a liquid crystal display, comprising:

in a normal frame period, providing a plurality of scanning signal to activate pixel units, and providing data voltage signals and a first common voltage signal to the activated pixel units, the first common voltage signal is an alternating current (AC) voltage signal;

entering a dummy cycle period when the normal frame period ends, and providing a second common voltage signal to the pixel units in the dummy cycle period so as to replace the first common voltage signal, the second common voltage signal is a direct current (DC) voltage signal; and entering a subsequent normal frame period when the dummy cycle period ends, and re-providing the first common voltage signal to the pixel units in the subsequent normal frame period so as to replace the second common voltage signal wherein the second common voltage signal is one of a positive voltage signal having a variable value and a negative voltage signal having a variable value; the dummy cycle period comprises a first sub-period at the beginning of the dummy cycle period, a second sub-period at the end of the dummy cycle period, and a third sub-period between the first and second sub-periods, a value of the second common voltage signal in the first sub-period is substantially the same as that in the second sub-period, and is less than that in the third sub-period.

15. The method of claim 14, wherein the first common voltage is an AC voltage signal having a positive value and a negative value alternate with each other in the normal frame period, and the second common voltage is a DC voltage signal having a predetermined value in a range between the positive value and the negative value of the AC voltage signal.

16. The method of claim 15, wherein the predetermined value is half of a sum of the positive value and the negative value of the common voltage signal in the normal frame period.

17. The method of claim 14, further comprising:

providing, during the dummy cycle period, a same predetermined square wave signal to all the pixel units as the scanning signals, wherein the predetermined square wave signal has a frequency substantially n times of the scanning signals in the normal frame period.

18. The method of claim 14, further comprising:

repeating, during the dummy cycle period, to output the data voltage signals of the normal frame period to the pixel units.

* * * * *